US009156586B2

(12) United States Patent
Girsh

(10) Patent No.: US 9,156,586 B2
(45) Date of Patent: Oct. 13, 2015

(54) TRANSPORT SYSTEM FOR COMPRESSED GAS CYLINDERS

(75) Inventor: Leonard Girsh, Southampton, PA (US)

(73) Assignee: Air Liquide America Specialty Gases LLC, Houston, TX (US)

( * ) Notice: Subject to any disclaimer, the term of this patent is extended or adjusted under 35 U.S.C. 154(b) by 456 days.

(21) Appl. No.: 13/601,362

(22) Filed: Aug. 31, 2012

(65) Prior Publication Data

US 2014/0061065 A1 Mar. 6, 2014

(51) Int. Cl.

| | |
|---|---|
| ***B65D 83/10*** | (2006.01) |
| ***B65D 19/44*** | (2006.01) |
| *B65D 85/64* | (2006.01) |
| *B65B 61/20* | (2006.01) |

(52) U.S. Cl.

CPC ..... *B65D 19/44* (2013.01); *B65B 61/207* (2013.01); *B65D 85/64* (2013.01); *B65D 2519/0081* (2013.01); *B65D 2519/00711* (2013.01); *B65D 2519/00815* (2013.01); *Y10T 29/49826* (2015.01)

(58) Field of Classification Search

USPC ..... 206/368, 595, 596, 597, 598, 600

See application file for complete search history.

(56) References Cited

U.S. PATENT DOCUMENTS

| | | | | | |
|---|---|---|---|---|---|
| 2,534,010 | A * | 12/1950 | Frye | 206/600 |
| 3,014,581 | A * | 12/1961 | Storck | 206/321 |
| 3,471,989 | A * | 10/1969 | Carliss | 53/397 |
| 3,602,368 | A * | 8/1971 | Gould | 206/598 |
| 3,638,790 | A * | 2/1972 | Schmid et al. | 206/446 |
| 4,324,333 | A * | 4/1982 | Porter | 206/526 |
| 4,481,972 | A * | 11/1984 | Stavlo | 137/376 |
| 5,078,415 | A * | 1/1992 | Goral | 280/79.2 |
| 5,144,897 | A * | 9/1992 | Avery | 108/55.3 |
| 5,176,265 | A * | 1/1993 | Bennett | 211/85.18 |
| 5,201,421 | A * | 4/1993 | Maier | 206/600 |
| 5,251,753 | A * | 10/1993 | Pigott et al. | 206/766 |
| 5,694,836 | A * | 12/1997 | Blevins | 99/517 |
| 6,056,255 | A * | 5/2000 | Meade | 248/313 |
| 6,267,255 | B1 * | 7/2001 | Brush | 211/59.4 |
| 7,017,741 | B1 * | 3/2006 | Williamson | 206/386 |
| 7,128,008 | B2 * | 10/2006 | Lothe | 114/74 A |
| 8,127,929 | B1 * | 3/2012 | Lu et al. | 206/600 |
| 8,474,491 | B2 * | 7/2013 | Lachman | 141/38 |
| 8,875,894 | B2 * | 11/2014 | Ness | 206/598 |
| 2006/0108249 | A1 * | 5/2006 | Riddleburgh et al. | 206/453 |

* cited by examiner

*Primary Examiner* — Jacob K Ackun

(74) *Attorney, Agent, or Firm* — Allen E. White

(57) ABSTRACT

The invention generally relates to a pallet or other flat platform having one or more, preferably two, perpendicular dividers secured to the surface of the flat platform and each other in a stable manner. Gas cylinder(s) are set in an upright position on the same surface of the flat platform as the divider(s). The cylinder(s) are secured, generally by steel bands or nylon straps, to the divider(s) and/or the flat platform surface.

19 Claims, 6 Drawing Sheets

TRANSPORT SYSTEM FOR COMPRESSED GAS CYLINDERS

TECHNICAL FIELD

The invention relates to containers, pallets and other restraining devices for use in safely handling and transporting cylinders containing liquefied and non-liquefied compressed gases for domestic and international commerce.

BACKGROUND ART

Shipping of compressed gases in cylinders requires a shipping container or cylinder restraining system that prevents damage to the cylinder and to the cylinder valve by its contents (if transporting cylinders containing liquefied compressed gases in any position other than upright). Transporting compressed gas cylinders properly, safely and in accordance with Government (US Department of Transportation), including international rules and industry regulations is a mandatory requirement. Emergency response hotline services recommend transporting compressed gas cylinders in upright position. Both the potential for cylinder damage and therefore the regulatory requirements in domestic and international transport are particularly high. Today, the normal means of shipping of individual or small numbers of cylinders is by custom built crates (FIG. 3) or in horizontal pyramids on standard shipping pallets (FIG. 2). Other restraining systems include strapping upright cylinders on railings of a flattop transport platform (FIG. 1). These current transport systems are expensive, non-recyclable/re-usable, heavy and/or make suboptimal use of space.

The instant disclosure provides an economical, safe, re-usable transport system that is light weight and makes optimal use of space by holding cylinders upright.

SUMMARY OF INVENTION

The invention may be understood in relation to the following numbered sentences:

1. A device for shipping and storing items comprising:
   a) A platform having a surface (80),
   b) The plurality of dividers (10, 20) comprising at least two dividers (10, 20), each having at least one slot (30, 40), wherein the at least one slot (30, 40) of a first divider (10) is configured to be capable of accepting a complementary portion of a second divider (20),
   c) The at least two dividers (10, 20) being interdigitated through the slots (30, 40) and secured (70, 85) to the same surface (80) of the platform, and with the at least two dividers (10, 20) projecting upward from the same surface (80) of the platform.
2. The device of sentence 1, further comprising a gas cylinder (100) resting on the same platform surface (80) and secured (60, 90) to at least one divider (10, 20).
3. The device of sentence 1 or 2, further comprising a gas cylinder (100) resting on the same platform surface (80) and secured (60, 90) to both of the at least two dividers (10, 20).
4. The device of sentence 1, 2 or 3, wherein the gas cylinder (100) is secured (60, 90) to the at least one divider (10, 20) by a cylinder band (90) wrapped around the cylinder (100) and wrapped around a portion of at least one divider (10, 20) through at least two divider apertures (60) through the at least one divider (10, 20).
5. The device of sentence 1, 2, 3 or 4 wherein the cylinder band (90) comprises steel, polyester, or nylon.

6. The device of sentence 1, 2, 3, 4 or 5 having only two dividers (10, 20).
7. The device of sentence 1, 2, 3, 4, 5 or 6 wherein the plurality of dividers (10, 20) are secured (70, 85) to the same surface (80) of the platform by at least two divider bands (70) wrapped around both one of the dividers (10, 20) and a portion of the platform (80) through at least two apertures (85) through the platform (80).
8. The device of sentence 7 wherein the divider bands (70) comprise steel, polyester, or nylon.
9. The device of sentence 1, 2, 3, 4, 5, 6, 7 or 8, further comprising a protective cover (110) secured to the dividers (10, 20) or the platform (80) or both.
10. The device of sentence 9 wherein the protective cover (110) is secured to the platform (80) by at least one cover band (120) passing through at least one protective cover aperture (140) and passing through at least one aperture (130) of the platform (80).
11. The device of sentence 10, having at least two the cover bands (120) passing through at least two protective cover apertures (140) and passing through at least two apertures (130) of the platform (80).
12. The device of sentence 9, wherein the protective cover (110) is secured to the dividers (10, 20).
13. The device of sentence 12 wherein the protective cover (110) is secured to the dividers (10, 20) by wire ties, cable ties, or an attachment means passing through at least one protective cover aperture (140) and least one divider aperture (60).
14. The device of sentence 10, 11, 12 or 13 wherein the cover bands (120) comprise steel, polyester, or nylon.
15. The device of sentence 9, 10, 11, 12 or 13 wherein the protective cover (110) comprises a plurality of holes (115) and the dividers (11, 21) comprise edge projections (15, 25) complementary to the plurality of holes (115).
16. The device of sentence 15, wherein the plurality of dividers (10, 20) are secured (70, 85) to the same surface (80) of the platform by at least two divider bands (70) wrapped around both
    a) one of the dividers (10, 20) and
    b) a portion of the platform (80) through at least two apertures (85) through the platform (80);
    wherein at least the dividers (11, 21) comprise edge indentions (16, 26) between the edge projections (15, 25); and
    wherein at least one edge indention (16, 26) is vertically aligned with at least one platform aperture (85) and at least one divider band (70) is wrapped through both the at least one edge indention (16, 26) and the at least one platform aperture (85) to thereby restrict lateral movement by the band (70).
17. The device of sentence 1, 2, 3, 4, 5, 6, 7, 8, 9, 10, 11, 12, 13, 14, 15 or 16, wherein the platform (80) consists of materials exempt under International Standards For Phytosanitary Measures No. 15.
18. The device of sentence 17, wherein all elements of the device (1) consists of materials exempt under International Standards For Phytosanitary Measures No. 15.
19. The device of sentence 1, 2, 3, 4, 5, 6, 7, 8, 9, 10, 11, 12, 13, 14, 15, 17 or 18, further comprising bracing stubs (50) on one or more dividers (10, 20).
20. The device of sentence 19, wherein the bracing stubs (50) are positioned to permit the distal end(s) (55) of an interdigitating divider (10, 20) to slide between thereby stabilizing a final assembly.

21. The device of sentence 9, 10, 11, 12, 13, 14, 15, 17, 18, 19 or 20, further comprising four awning slats (200) with each awning slat (200) having with three awning notches (220, 230, 240) wherein
   a) a middle awning notch (220) is configured to complement a receptacle notch (210) in a divider (10, 20) and each of the four middle notches (220) are in said complementary configuration with said divider (250) and
   b) two distal awning notches (230, 240) are configured to each complement one distal awning notch (230, 240) of two separate awning slats (200) and all distal awning notches (230, 240) are in said complementary configuration.
22. The device of sentence 21 wherein at least one four awning slat (200) comprises at least one edge projection and the protective cover (110) comprises an aperture complementary to the at least one edge projection and the at least one edge projection of the awning is in a complementary configuration with the protective cover aperture.
23. A method of assembling a device for shipping and storing items comprising the steps of:
   a) Providing a platform having a flat surface (80) and a plurality of apertures (85),
   b) Providing at least two dividers (10, 20), each having at least one slot (30, 40), configured to be capable of accepting a complementary portion of another divider (10,20),
   c) Sliding the slots (30, 40) over the complementary portion of another divider (10,20) to interdigitate the dividers (10, 20),
   d) Securing (70, 85) the plurality of interdigitated dividers (10, 20) to the same surface (80) of the platform, and with the plurality of dividers (10, 20) projecting upward from the same surface (80) of the platform.
24. The method of sentence 23, further comprising the steps of resting a gas cylinder (100) on the same platform surface (80) and securing (60, 90) the gas cylinder (100) to at least one divider (10, 20).
25. The method of sentence 24, further comprising the steps of
   a) placing a protective cover (110) on the interdigitated dividers (10, 20) and over the cylinder (100) and
   b) Securing the protective cover (110) to the interdigitated dividers (10, 20), the platform (80), or both.
26. The method of sentence 24 or 25, further comprising the steps of
   a) Providing four awning slats (200) with each awning slat (200) having with three awning notches (220, 230, 240), wherein
      A) a middle awning notch (220) is configured to complement a receptacle notch (210) in a divider (10, 20),
      B) two distal awning notches (230, 240) are configured to each complement one distal awning notch (230, 240) of two separate awning slats (200),
   b) Placing each of the four middle notches (220) in a complementary configuration with said divider (250) and placing all distal awning notches (230, 240) in a complementary configuration with a corresponding distal awning notch (230, 240) on a separate awning slat (200),
   c) Placing a protective cover (110) on the interdigitated dividers (10, 20) and the four awning slats (200) and over the cylinder (100), and
   d) Securing the protective cover (110) to the interdigitated dividers (10, 20), the platform (80), or both.

DISCLOSURE OF INVENTION

The invention generally relates to a pallet or other flat platform having one or more, preferably two, perpendicular dividers secured to the surface of the flat platform and each other in a stable manner. Gas cylinder(s) are set in an upright position on the same surface of the flat platform as the divider(s). The cylinder(s) are secured, generally by steel banding or nylon straps, to the divider(s) and/or the flat platform surface.

MODE(S) FOR CARRYING OUT THE INVENTION

Figure 1:
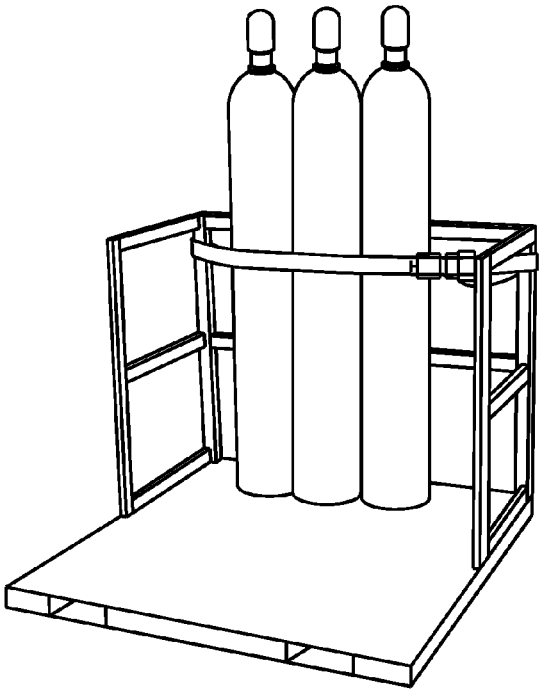
(Prior Art) FIGURE 1
FIG. 1 is a prior art cylinder restraining system made of metal.
Figure 2:
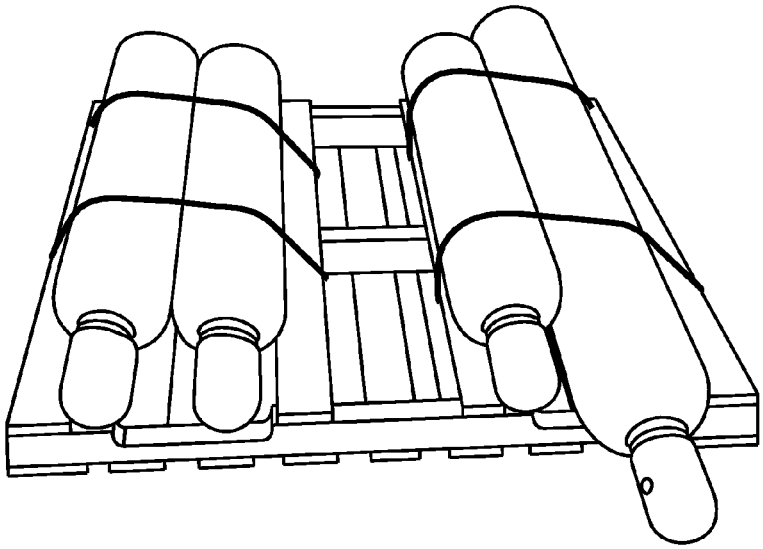
(Prior Art) FIGURE 2
FIG. 2 is a prior art shipping system using standard pallets.
Figure 3:
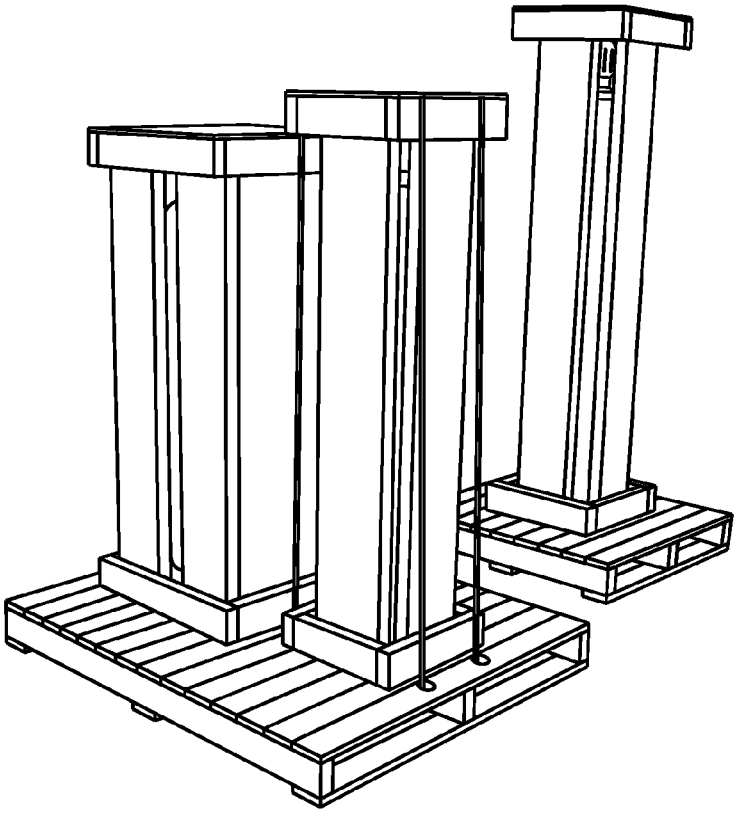
(Prior Art) FIGURE 3
FIG. 3 shows a prior art shipping system using custom built crates.
Figure 4:
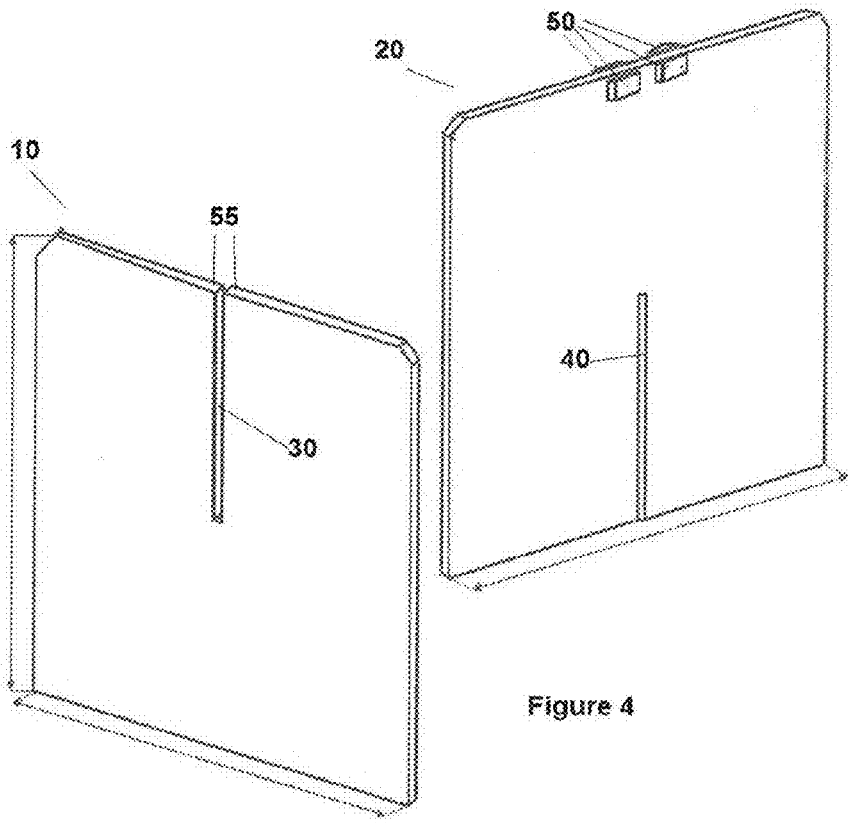
FIG. 4 shows an embodiment of the divider components of a transport system of the present invention.

FIG. 4 shows part of an embodiment of the invention having two dividers (10, 20) each having midline slots (30, 40) with dimensions selected to enable the slots to slide over the complementary contiguous sections of the other divider. This forms a "+" configuration. Alternative arrangements may have the slots off center and/or more than one slot (34, 40) per divider (10, 20) to enable three or more slotting dividers to form additional configurations. Bracing stubs (50) optionally may be present on one or more dividers, generally at the distal edge thereof. These bracing stubs are positioned to allow the distal end(s) (55) of an interdigitating divider to slide between, thus stabilizing the final assembly.

Figure 5:
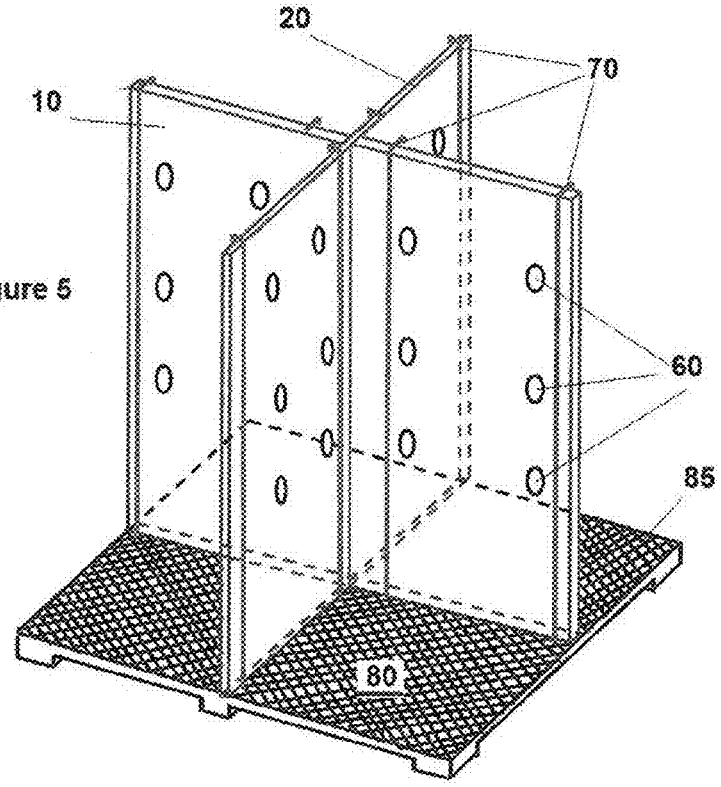
FIG. 5 shows the divider components of FIG. 4 in a completed basic transport system including a pallet base platform.
Figure 6:
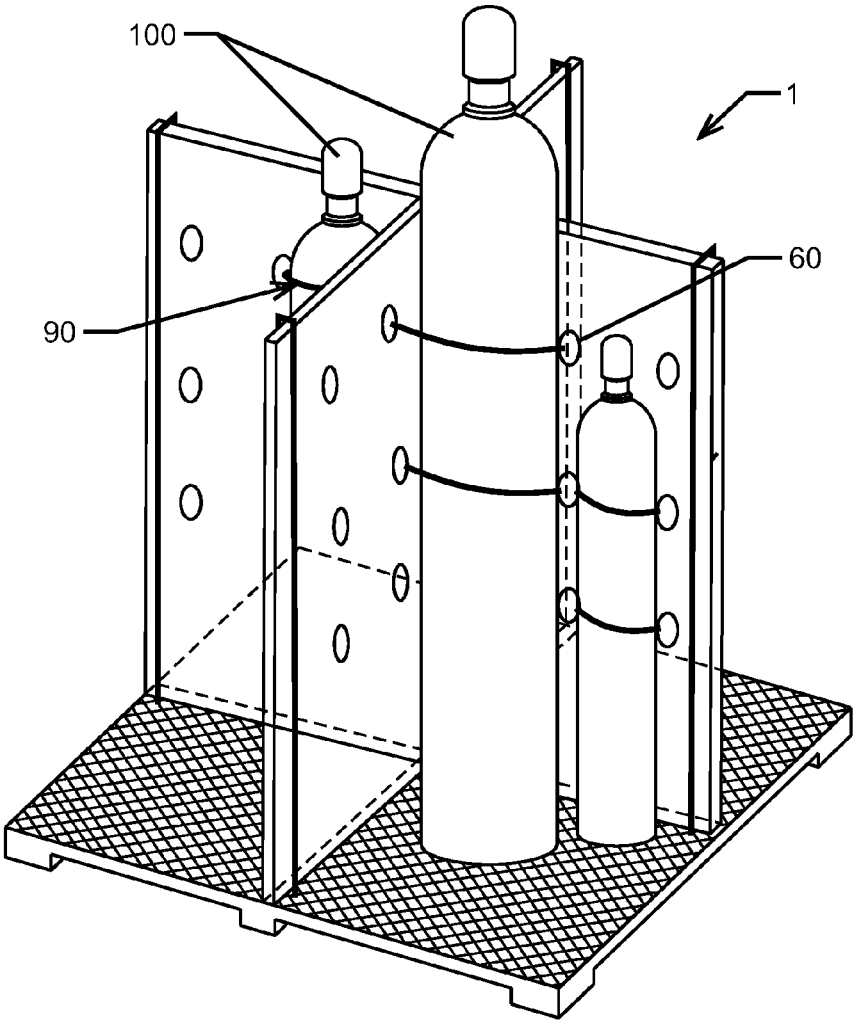
FIG. 6 shows the embodiment of the transport system in FIGS. 4-5 having gas cylinders strapped onto the transport system.

FIG. 5 shows the final assembly including the interdigitated dividers (10, 20, 30, 40) of FIG. 4. The interdigitated dividers (10, 20, 30, 40) are secured to a flat platform such as a pallet (80). The pallets generally have a plurality of holes (85) but may optionally and/or alternatively have anchor hooks or other structures for securing items thereto. The dividers (10, 20) may be secured to the platform (80) in any suitable manner, but preferably the dividers are secured to the platform by steel or nylon bands (70). In this embodiment, a plurality of holes (60) is in the dividers (10, 20). As shown in FIG. 6, these holes (60) are configured to permit additional steel or nylon bands (90) to hold upright cylinders (100) securely on the transport system (1). The cylinders (100) may be of different heights and diameters as long as they are dimensionally compatible with the platform (80) and dividers (10, 20).

Figure 7:
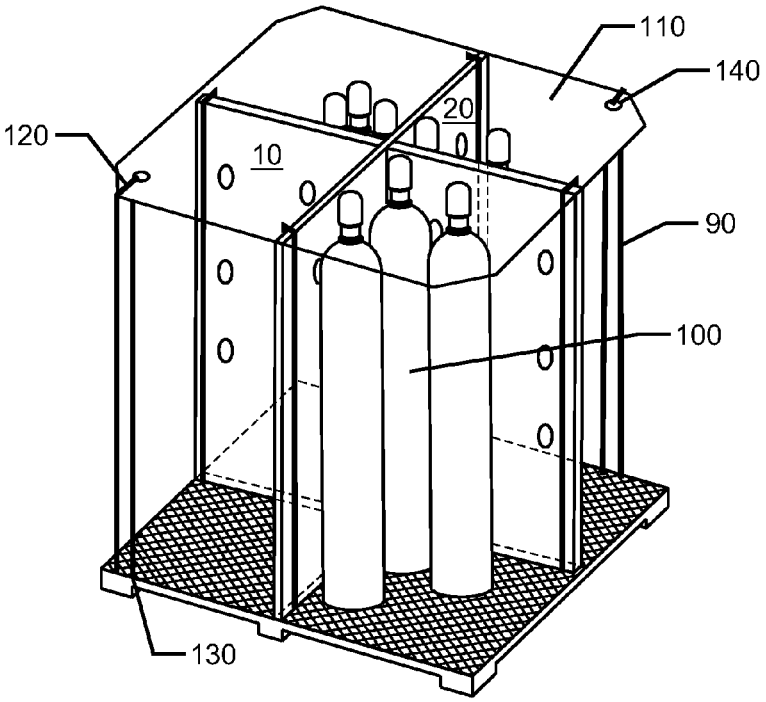
FIG. 7 shows an alternative embodiment have a protective cover.
Figure 8:
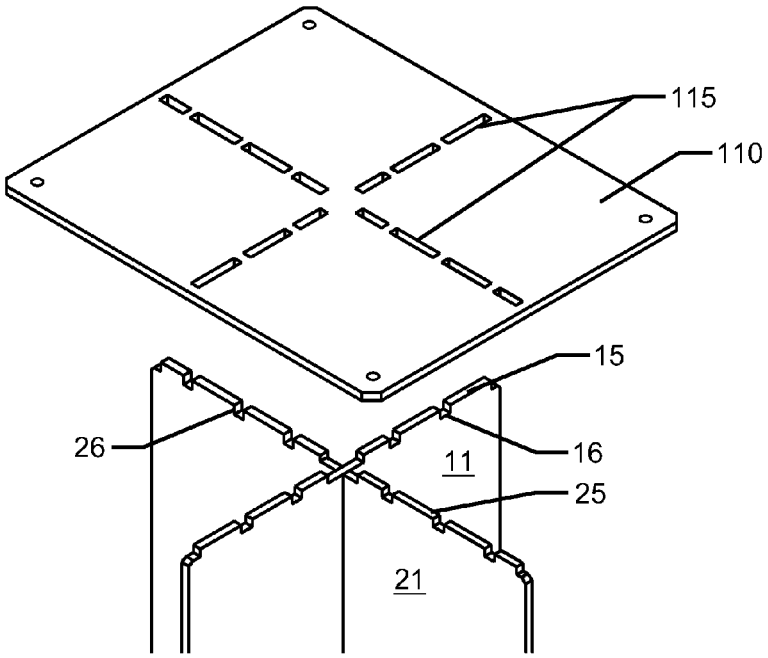
FIG. 8 shows an embodiment having a protective cover with holes complemented by edge projections on dividers adapted to position and secure the protective cover on the device.

FIG. 7 shows an embodiment having a protective top (110) secured over the dividers (10, 20) and the cylinders (100) by at least two steel or nylon bands (120). FIG. 8 shows a version of the protective top (110) having a plurality of slots (115) and dividers (11, 21) having complementary to edge projections (15, 25). These complementary projections and slots allow the protective top (110) to be positioned correctly and further stabilize the final assembly.

Figure 9:
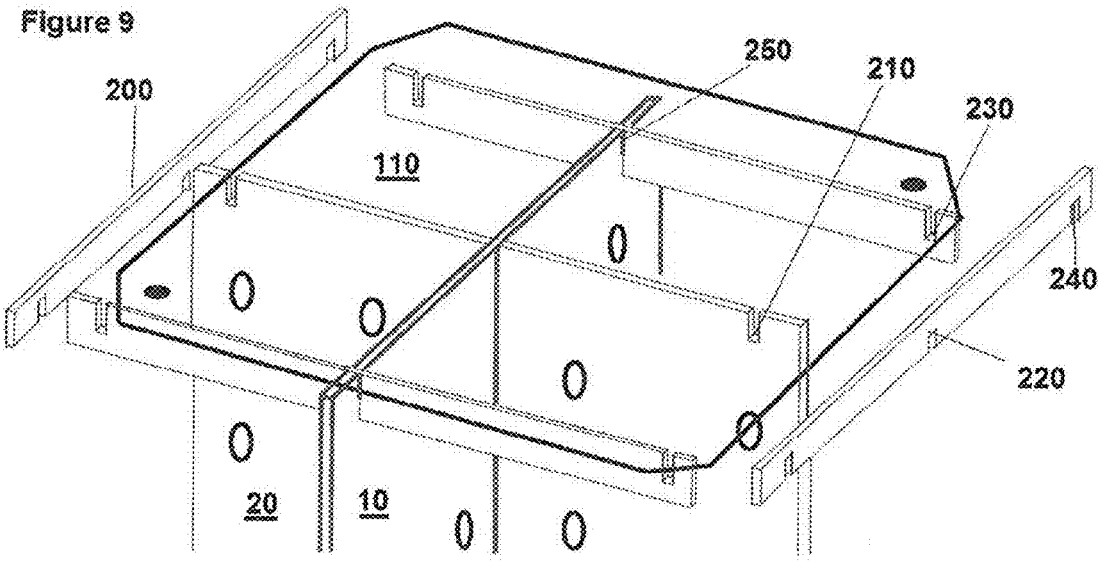
FIG. 9 shows another optional feature of awning slates or overhang barriers that may be added to the device to further protect cylinders or other items on the device.

FIG. 9 shows an optional awning or overhang slate system (200) with four awning slats (200) each with complementary notches (220, 230, 240) for interdigitating with a divider (250) and two other slats to form a contiguous peripheral overhang from the protective cover (110) in the final assembly.

INDUSTRIAL APPLICABILITY

The present invention is at least industrially applicable to shipping compressed gas cylinders.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing (i.e., anything else may be additionally included and remain within the scope of "comprising"). "Comprising" as used herein may be replaced by the more limited transitional terms "consisting essentially of" and "consisting of" unless otherwise indicated herein.

Optional or optionally means that the subsequently described event or circumstances may or may not occur. The description includes instances where the event or circumstance occurs and instances where it does not occur.

"Providing" in a claim is defined to mean furnishing, supplying, making available, or preparing something. The step may be performed by any actor in the absence of express language in the claim to the contrary.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A device for shipping and storing items comprising:

a) a platform having a surface (80), b) the plurality of dividers (10, 20) comprising at least two dividers (10, 20), each having at least one slot (30, 40), wherein the at least one slot (30, 40) of a first divider (10) is configured to be capable of accepting a complementary portion of a second divider (20), c) the at least two dividers (10, 20) being interdigitated through the slots (30, 40) and secured (70, 85) to the same surface (80) of the platform, and with the at least two dividers (10, 20) projecting upward from the same surface (80) of the platform, d) a protective cover (110) secured to the dividers (10, 20) or the platform (80) or both, wherein the protective top (110) comprises a plurality of holes (115) and the dividers (11, 21) comprise edge projections (15, 25) complementary to the plurality of holes (115);

wherein the plurality of dividers (10, 20) are secured (70, 85) to the same surface (80) of the platform by at least two divider bands (70) wrapped around both one of the dividers (10, 20) and a portion of the platform (80) through at least two apertures (85) through the platform (80);

wherein at least the dividers (11, 21) comprise edge indentions (16, 26) between the edge projections (15, 25); and wherein at least one edge indention (16, 26) is vertically aligned with at least one platform aperture (85) and at least one divider band (70) is wrapped through both the at least one edge indention (16, 26) and the at least one platform aperture (85) to thereby restrict lateral movement by the band (70).

2. The device of claim 1, further comprising a gas cylinder (100) resting on the same platform surface (80) and secured (60, 90) to at least one divider (10, 20).

3. The device of claim 1, further comprising a gas cylinder (100) resting on the same platform surface (80) and secured (60, 90) to both of the at least two dividers (10, 20).

4. The device of claim 2, wherein the gas cylinder (100) is secured (60, 90) to the at least one divider (10, 20) by a cylinder band (90) wrapped around the cylinder (100) and wrapped around a portion of at least one divider (10, 20) through at least two divider apertures (60) through the at least one divider (10, 20).

5. The device of claim 4, wherein the cylinder band (90) comprises steel, polyester, or nylon.

6. The device of claim 1 having only two dividers (10, 20).

7. The device of claim 1, wherein the plurality of dividers (10, 20) are secured (70, 85) to the same surface (80) of the platform by at least two divider bands (70) wrapped around both one of the dividers (10, 20) and a portion of the platform (80) through at least two apertures (85) through the platform (80).

8. The device of claim 7, wherein the divider bands (70) comprise steel, polyester, or nylon.

9. The device of claim 1, wherein the protective cover (110) is secured to the platform (80) by at least one cover band (120) passing through at least one protective cover aperture (140) and passing through at least one aperture (130) of the platform (80).

10. The device of claim 9, having at least two the cover bands (120) passing through at least two protective cover apertures (140) and passing through at least two aperture (130) of the platform (80).

11. The device of claim 1, wherein the protective cover (110) is secured to the dividers (10, 20).

12. The device of claim 11, wherein the protective cover (110) is secured to the dividers (10, 20) by wire ties or cable ties passing through at least one protective cover aperture (140) and least one divider aperture (60).

13. The device of claim 9, wherein the cover bands (120) comprise steel, polyester, or nylon.

14. The device of claim 1, wherein the platform (80) consists of materials exempt under International Standards For Phytosanitary Measures No. 15.

15. The device of claim 14, wherein all elements of the device (1) consists of materials exempt under International Standards For Phytosanitary Measures No. 15.

16. The device of claim 1, further comprising bracing stubs (50) on one or more dividers (10, 20).

17. The device of claim 16, wherein the bracing stubs (50) are positioned to permit the distal end(s) (55) of an interdigitating divider (10, 20) to slide between thereby stabilizing a final assembly.

18. A device for shipping and storing items comprising:

a) a platform having a surface (80), b) the plurality of dividers (10, 20) comprising at least two dividers (10, 20), each having at least one slot (30, 40), wherein the at least one slot (30, 40) of a first divider (10) is configured to be capable of accepting a complementary portion of a second divider (20), c) the at least two dividers (10, 20) being interdigitated through the slots (30, 40) and secured (70, 85) to the same surface (80) of the platform, and with the at least two dividers (10, 20) projecting upward from the same surface (80) of the platform, d) a protective cover (110) secured to the dividers (10, 20) or the platform (80) or both, wherein the protective top (110) comprises a plurality of holes (115) and the dividers (11, 21) comprise edge projections (15, 25) complementary to the plurality of holes (115);

the device further comprising four awning slats (200) with each awning slat (200) having with three awning notches (220, 230, 240) wherein a) a middle awning notch (220) is configured to complement a receptacle notch (210) in a divider (10, 20) and each of the four middle awning notches (220) are in said complementary configuration with said divider (250) and b) two distal awning notches (230, 240) are configured to each complement one distal awning notch (230, 240) of two separate awning slats (200) and all distal awning notches (230, 240) are in said complementary configuration.

19. The device of claim 18, wherein at least one four awning slat (200) comprises at least one edge projection and the protective cover (110) comprises an aperture complementary to the at least one edge projection and the at least one edge projection of the awning is in a complementary configuration with the protective cover aperture.

* * * * *